US007171153B2

(12) United States Patent
Eguchi

(10) Patent No.: US 7,171,153 B2
(45) Date of Patent: Jan. 30, 2007

(54) IMAGE FORMING APPARATUS

(75) Inventor: Naomi Eguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/855,718

(22) Filed: May 28, 2004

(65) Prior Publication Data

US 2004/0247355 A1 Dec. 9, 2004

(30) Foreign Application Priority Data

Jun. 3, 2003 (JP) ..... 2003-157695

(51) Int. Cl.
*G03G 15/00* (2006.01)
*B65H 5/22* (2006.01)

(52) U.S. Cl. ..... 399/391; 399/363; 399/371; 399/372; 399/381; 399/395; 271/3.08; 271/3.09

(58) Field of Classification Search ..... 399/391, 399/363, 371, 372, 381, 395; 271/3.08, 3.09
See application file for complete search history.

(56) References Cited

U.S. PATENT DOCUMENTS 6,148,172 A * 11/2000 Kanda et al. ..... 399/391
6,691,998 B2 * 2/2004 Mori ..... 271/9.05

FOREIGN PATENT DOCUMENTS

JP 11-193149 7/1999

* cited by examiner

*Primary Examiner*—Daniel J. Colilla
*Assistant Examiner*—Marvin P. Crenshaw
(74) *Attorney, Agent, or Firm*—Rabin & Berdo, PC

(57) ABSTRACT

The image forming apparatus includes an image forming unit installed in a main body of the image forming apparatus and a tray stack including stacked media supplying units for supplying the media piece from selected one of the stacked media supplying units to the image forming unit. The tray stack is detachable from and attachable to the main body. The tray stack includes a register installed only in uppermost one of the stacked media supplying units. The register functions to correct skew of the media piece with respect to a transport direction along which the media piece is transported and then feed the media piece to the image forming unit.

16 Claims, 9 Drawing Sheets

IMAGE FORMING APPARATUS

FIELD OF THE INVENTION

The present invention relates to an image forming apparatus and a media-supplying unit for use in the image forming apparatus.

BACKGROUND OF THE INVENTION

FIG. 9 shows a conventional image forming apparatus. This image forming apparatus includes a main body 1, a paper tray unit 2 having a paper tray and a paper feed roller 3 for feeding sheets of paper by ones into the main body 1 from the paper tray, a skew-correcting device 4 constituted by a pair of rollers which transports the paper (represented by the numeral 8 in FIG. 9) fed by the paper feed roller 3 while correcting the skew of the paper, a paper sensor 5 for detecting the front edge of the paper, an image forming unit 6 having an image drum and a transference roller for forming an image on the paper, and a fixing unit 7 having a heater and rollers for fixing the image on the paper.

When the paper supplied from the paper tray by the paper feed roller 3 has reached the skew-correcting device 4, the paper sensor 5 detects the front edge of the paper and generates a signal. The paper feed roller 3 continues to rotate even after receiving the signal generated by the paper sensor 5 to further feed the paper by a predetermined amount. In consequence, the skew of the paper, that is, the inclination of the paper with respect to the direction along which the paper is transported, is corrected, since the front edge of the paper strikes on the nipping portion of the skew-correcting device 4 which is at a standstill, and the paper therefore bends there. After that, the rollers of the skew-correcting device 4 start to rotate for transporting the paper to the image forming unit 6. The image formed on the paper by the image forming unit 6 is fixed by the fixing unit 7. After that, the paper is discharged.

It is known to provide such an image forming apparatus with a plurality of paper tray units to enable users to set a large number of sheets of paper as disclosed in Japanese Patent Application Laid-Open No. 11-193149. Each paper tray unit has a skew-correcting device. The skew of the paper supplied from one paper tray unit is corrected by the skew-correcting device of this one paper tray unit and also by the skew-correcting devices of other paper tray units disposed above this one paper tray unit. To be more specific, in a case where the paper is supplied from one of the paper tray units (here, referred to as "paper tray unit in question"), a paper feed roller installed in the paper tray unit in question continues to rotate even after a paper sensor installed in the paper tray unit in question detects that the paper has reached a skew-correcting device installed in the paper tray unit in question in order to further feed the paper by a predetermined amount, whereby the skew of the paper is corrected. Even when a paper sensor installed in another paper tray unit disposed immediately above the paper tray unit in question detects that the paper has reached a skew-correcting device of this paper tray unit, the paper feed roller and the rollers of the skew-correcting device of the paper tray unit in question continue to rotate to feed the paper by a predetermined amount for correcting the skew of the paper again. Thus, the paper supplied from the paper tray unit in question goes into the main body after undergoing the skew correction multiple times by the skew-correcting devices of the paper tray unit in question and other paper tray units disposed above the paper tray unit in question.

As previously explained, when the paper reaches the skew-correcting device disposed upstream from the image forming unit, the skew of the paper is corrected since the paper strikes on the skew-correcting device and is bent there. After the skew of the paper is corrected, the rollers of the skew-correcting device start to rotate to transport the paper to the image forming unit where an image is formed on the paper, and after that the paper is discharged.

Conventionally, in the case of using a plurality of the paper tray units having the structure described above for supplying paper to the image forming apparatus, the paper supplied from one of the paper tray units stops and undergoes the skew correction at each of the skew-correcting devices of other paper tray units through which it passes. Accordingly, there is a problem that printing speed is lowered since the paper stops again and again before it goes into the main body of the image forming apparatus, especially in supplying paper from tray units distant from the main body of the image forming apparatus. There is also another problem that a complicated control mechanism is required for controlling execution of the skew correction by each of the paper tray units.

SUMMARY OF THE INVENTION

The present invention has been made to remove such problems with an object to provide a high-speed image forming apparatus attached with a stack of media feed units which can form an image on the media at a high speed even in feeding the media from one of the media feed unit that is on the distant side of the main body of the image forming apparatus.

The object can be achieved by an image forming apparatus comprising:

an image forming unit installed in a main body of the image forming apparatus for forming an image on a media piece;

a media supplying unit for supplying the media piece to the image forming unit, the media supplying unit being detachable from and attachable to the main body;

wherein the media supplying unit includes:

a register which functions to feed the media piece to the main body from the media supplying unit when the register is set in a first mode and functions to correct skew of the media piece with respect to a transport direction along which the media piece is transported and then feed the media piece to the to the image forming unit when the register is set in a second mode; and a controller for setting the register to one of the first mode and the second mode in accordance with an instruction received from outside.

The object can be achieved also by an image forming apparatus comprising:

an image forming unit installed in a main body of the image forming apparatus for forming an image on a media piece;

a tray stack including stacked media supplying units for supplying the media piece from selected one of the stacked media supplying units to the image forming unit, the tray stack being detachable from and attachable to the main body;

wherein the tray stack includes:

a register installed in one of the stacked media supplying units which functions to correct skew of the media piece with respect to a transport direction along which the media piece is transported and then feed the media piece to the image forming unit.

The object can be achieved also by an image forming apparatus comprising:

an image forming unit installed in a main body of the image forming apparatus for forming an image on a media piece;

a tray stack including stacked media supplying units for supplying the media piece from selected one of the stacked media supplying units to the image forming unit, the tray stack being detachable from and attachable to the main body;

wherein each of the stacked media supplying unit includes:

a register which functions to feed the media piece to the image forming unit when the register is set in a first mode and functions to correct skew of the media piece with respect to a transport direction along which the media piece is transported and then feed the media piece to the image forming unit when the register is set in a second mode; and a controller for setting the register to one of the first mode and the second mode in accordance with an instruction received from outside.

BRIEF DESCRIPTION OF THE DRAWINGS

Embodiments of the invention will now be described by way of example and with reference to the accompanying drawings in which.

DESCRIPTION OF THE PREFERRED EMBODIMENTS

Figure 1:
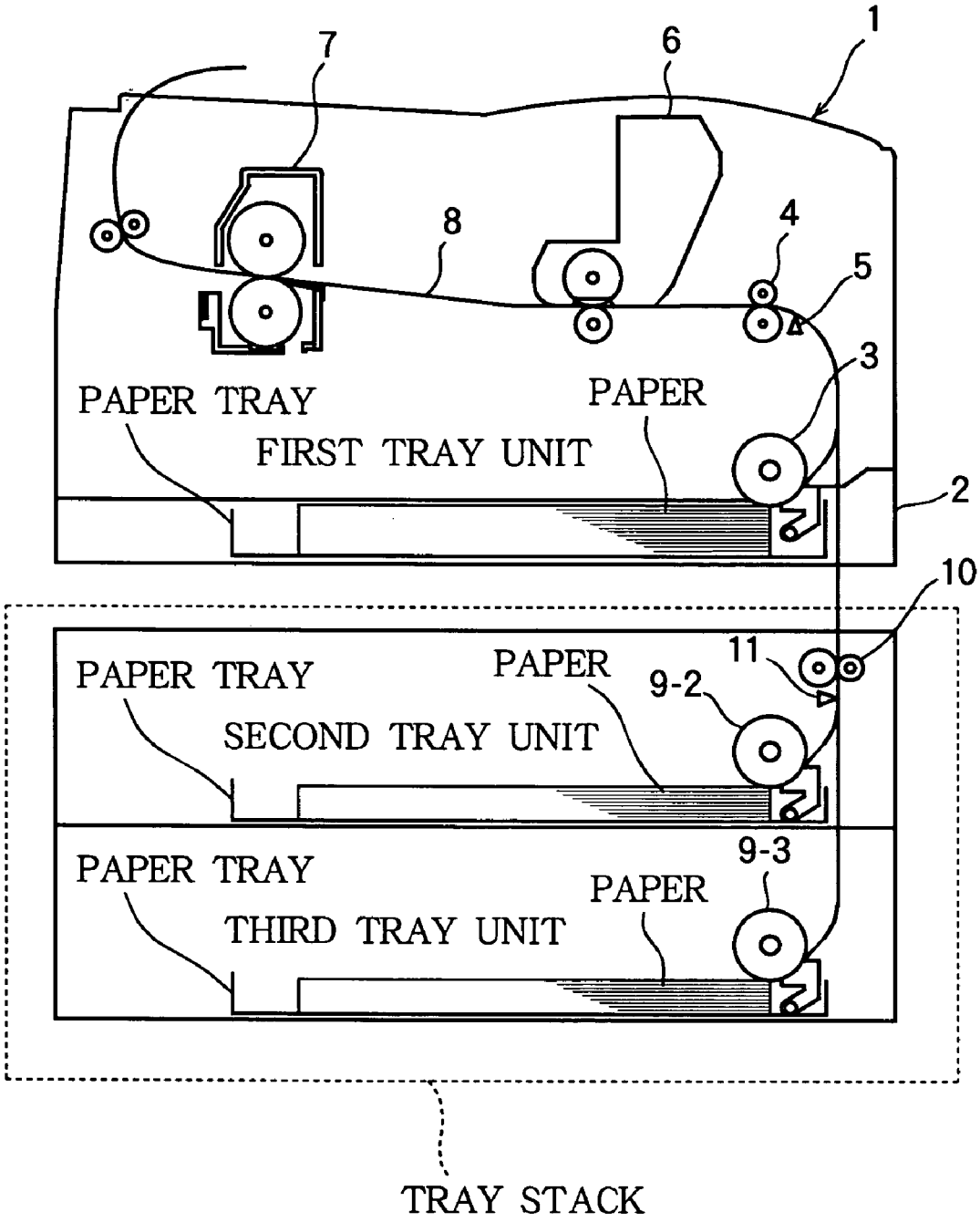
FIG. 1 shows a structure of an image forming apparatus according to a first embodiment of the present invention.

FIG. 1 shows a structure of an image forming apparatus according to a first embodiment of the present invention. This image forming apparatus has stacked tray units other than the tray unit (the first tray unit in FIG. 1) set in its main body. Each of the tray units is detachable. Of all the stacked tray units, the one (the second tray unit in FIG. 1) which is on the nearest side of the main body is provided with a register for performing skew collection. The other tray unit (the third tray unit in FIG. 1) may not be provided with the register.

In FIG. 1, 1 denotes the main body of the image forming apparatus, 2 denotes the first tray unit having a paper tray and a paper feed roller 3 for feeding paper by ones from the paper tray, 4 denotes the register constituted by a pair of rollers, and 5 denotes a paper sensor. The pair of rollers constituting the register 4 is set to start to rotate after the paper supplied strikes on the register 4 and thereby the skew of the paper is corrected. The paper sensor 5 generates a signal used for timing the start of the rotation of the rollers of the register 4.

6 denotes an image forming unit constituted by an image drum on which an image is formed and a transference roller. 7 denotes a fixing unit constituted by a heater and a pressing roller for fixing the image formed by the image forming unit to the paper. 9 denotes a paper feed roller installed in each of the stacked tray units for feeding sheets of paper by ones. 10 denotes a register constituted by two rollers and installed in the second tray unit. 11 denotes a paper sensor for detecting the front edge of the paper supplied (represented by the numeral 8 in FIG. 1). The pair of rollers constituting the register 10 is set to stat to rotate after the paper strikes thereon and the skew of the paper is therefore corrected. The paper sensor 11 is for generating a signal used for controlling timing of driving the rollers of the register 10 to rotate.

Figure 2:
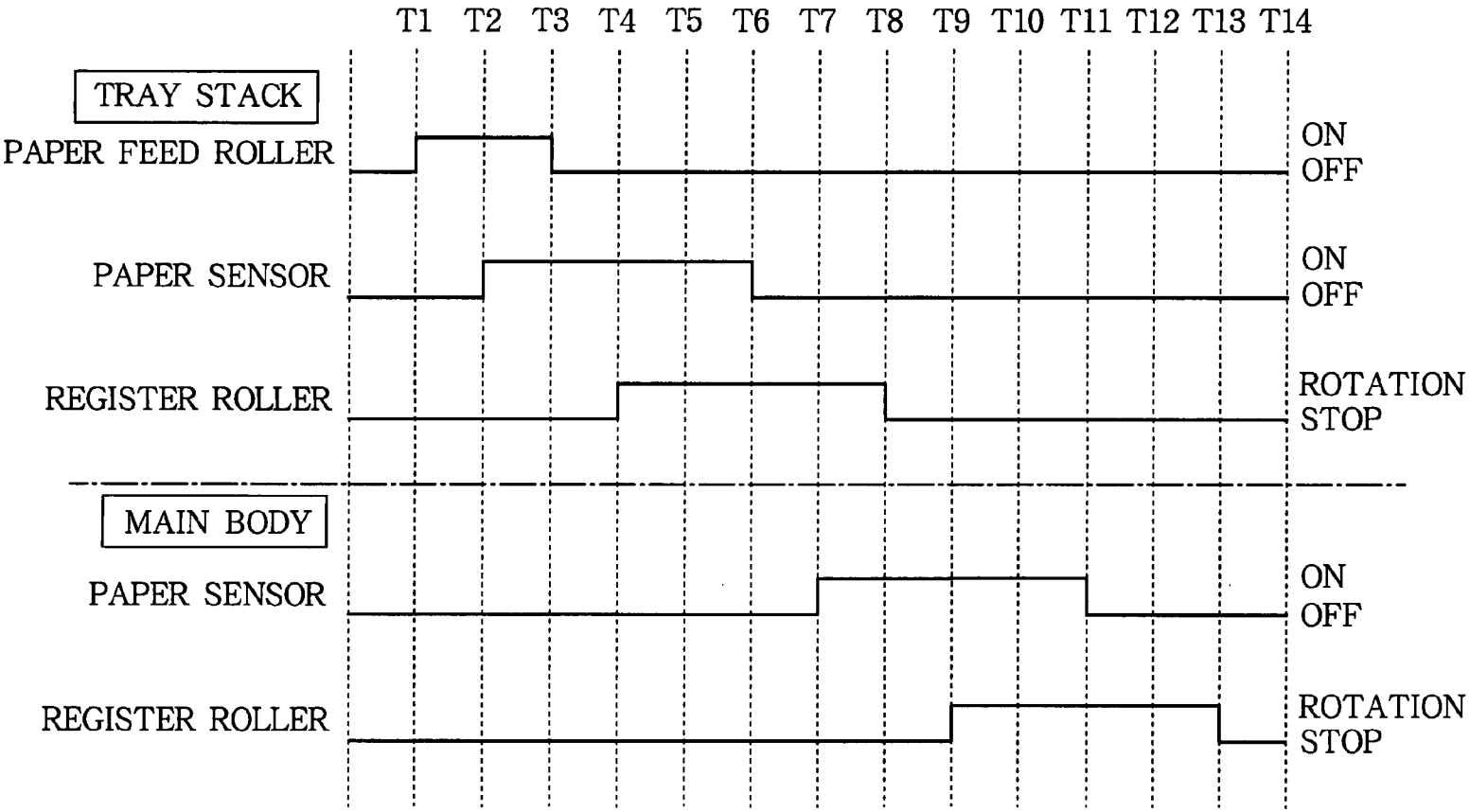
FIG. 2 is a time chart for explaining the operation of the image forming apparatus according to the first embodiment.

Next, the operation of the image forming apparatus having the structure described above will be explained with reference to a time chart shown in FIG. 2. In a case where the second tray unit supplies paper, the paper feed roller 9-2 of the second tray unit operates (T1) to feed paper from the paper tray of the second tray unit. When the paper has reached the register 10, the paper sensor 11 is turned on (T2). The register 10 remains at a standstill at this moment. The paper feed roller 9-2 continues to rotate even after the paper sensor 11 is turned on for a predetermined time period in order to further feed the paper by a predetermined amount. In consequence, the paper is bent between the paper feed roller 9-2 and the register 10. Then the paper feed roller 9-2 is stopped in a state of the paper being bent (T3). The bend of the paper between the paper feed roller 9-2 and the register 10 causes the front edge of the paper to strike on the rollers of the register 10 throughout its length so that the skew of the paper is corrected. After the skew of the paper is corrected, the pair of rollers constituting the register 10 is driven to rotate (T4) so that the paper is fed into the main body of the image forming apparatus.

When the paper has reached the register 4 within the main body, the paper sensor 5 is turned on (T7). The rollers of the register 10 continue to rotate even after the paper sensor 5 is turned for a predetermined time period in order to further feed the paper for a predetermined amount. In consequence, the paper is bent between the register 4 within the main body and the register 10 within the second tray unit so that the skew of the paper is corrected. After the skew of the paper is corrected, the pair of rollers constituting the register 4 of the main body is driven to rotate (T9) so that the paper is transported to the image forming unit 6 where an image is formed on the paper. After that, the paper is transported to the fixing unit 7 to fix the image on the paper, and then discharged.

In a case where the paper is supplied form the third tray unit, the paper feed roller 9-3 installed in the third tray unit rotates to transport the paper from the paper tray of the third tray unit to the register 10 of the second tray unit.

The operation of the image forming apparatus after the paper sensor 11 of the second tray unit is turned on is the same as that in the above described case where the paper is supplied from the second paper tray unit.

In this embodiment, only one of the stacked tray units which is closest to the main body of the image forming apparatus (the uppermost tray unit in this embodiment), is provided with the skew correcting means or the register, and the skew correction is executed at the tray stack and the main body respectively. That is to say, the skew correction is executed twice in all. Accordingly, compared to conventional apparatuses in which the skew correction is executed at each one of the tray units of the tray stack, printing speed can be made high and the control mechanism can be made simple. In addition, since the register or the skew correcting means of the tray stack is constituted by two rollers, it is possible to share components between the register of the main body and the register of the tray stack, and to share the motive power between the paper feed rollers and the register of the tray stack.

Besides, since the skew of the paper is corrected within the tray unit which is closest to the main body of all the tray units of the tray stack attached to the main body, the skew of the paper can be removed with reliability before the paper enters the main body.

An image forming apparatus according to a second embodiment of the invention will be explained. The structure of the image forming apparatus according to the second embodiment is the same as that of the image forming apparatus according to the first embodiment. Accordingly, the explanation of the structure of the image forming apparatus according to the second embodiment will be omitted, and its operation in the case of supplying paper from the second tray unit will be explained below with reference to a time chart shown in FIG. 3.

First, the paper feed roller 9-2 of the second tray unit starts to rotate (T1) to feed paper from the paper tray of the second tray unit. When the paper has reached the register 10 of the second tray unit, the paper sensor 11 is turned on (T2). The register 10 remains at a standstill at this moment. The paper feed roller 9-2 continues to rotate even after the paper sensor 11 is turned on for a predetermined time period in order to further feed the paper by a predetermined amount. In consequence, the paper is bent between the paper feed roller 9-1 and the register 10. Then the paper feed roller 9-1 is stopped in a state of the paper being bent (T3). The bend of the paper causes the front edge of the paper to strike on the rollers of the register 10 throughout its length so that the skew of the paper is corrected.

After the skew is corrected, the pair of rollers constituting the register 10 of the second tray unit is driven to rotate (T4). In this embodiment unlike the first embodiment, the pair of rollers constituting the register 4 of the main body is driven to rotate at this time (T4) while invalidating the output of the paper sensor 4 to transport the paper from the tray stack to the image forming unit 6 where an image is formed on the paper. After that, the paper is transported to the fixing unit to fix the image and discharged.

In a case where the paper is supplied from the tray unit which is the second closest to the main body or the third tray unit in this embodiment, the paper feed roller 9-3 installed in the third tray unit starts to rotate. The paper supplied from the paper tray of the third tray unit is transported to the register 10 the second tray unit. The operation of the image forming apparatus after the paper sensor 11 of the second tray unit is turned on is the same as that in the above explained case where the paper is supplied from the second paper tray unit.

In this embodiment, since the pair of rollers constituting the register 10 of the second tray unit and the pair of rollers constituting the register 4 of the main body are caused to start to rotate at the same time, and the skew correction is executed only once by the resister 10 of the tray stack, the printing speed can be made faster and the control mechanism can be made simpler than the first embodiment in which the skew correction is executed within each of the main body and the tray stack.

Figure 4:
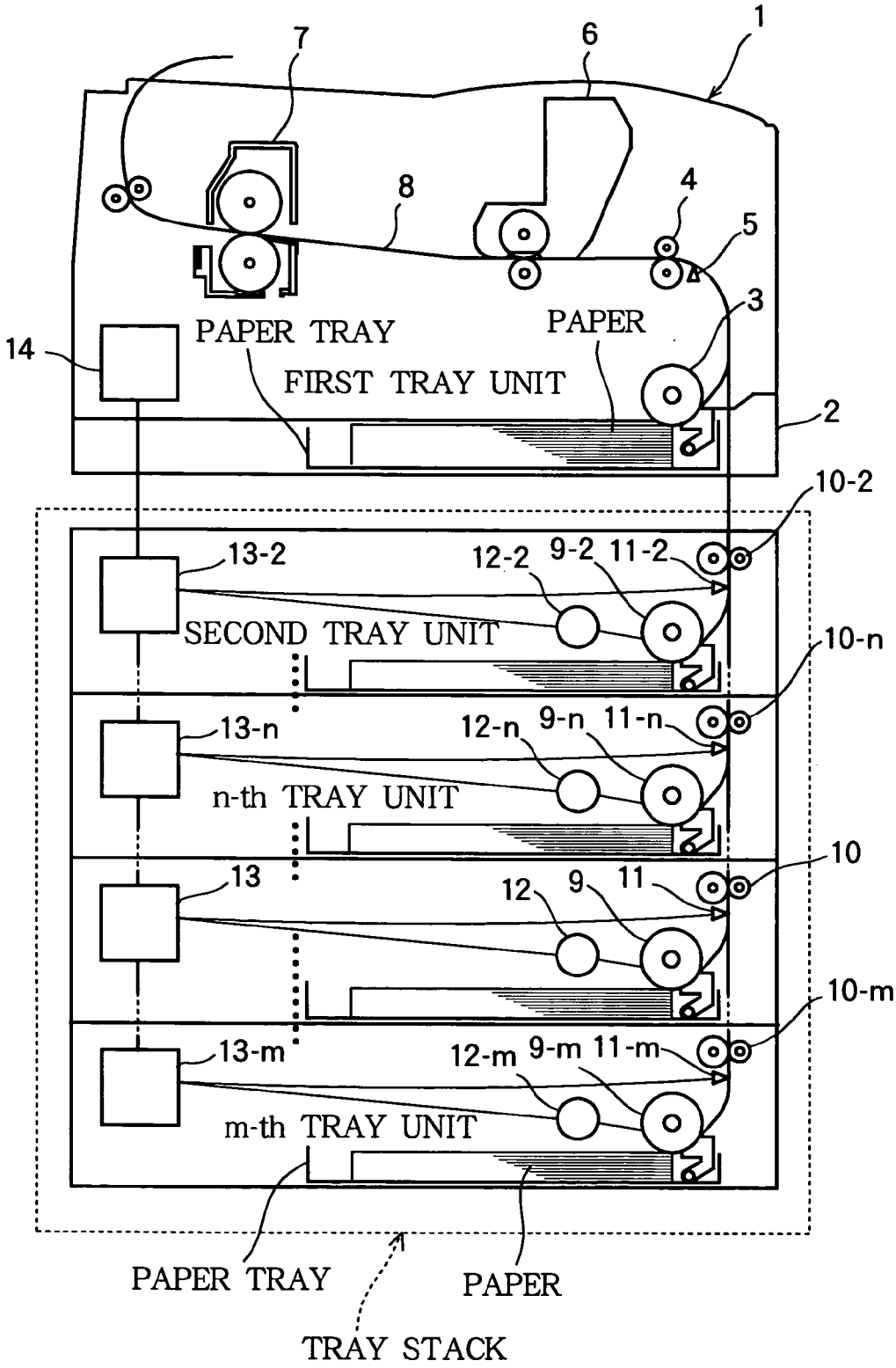
FIG. 4 shows a structure of an image forming apparatus according to a third embodiment of the present invention.

FIG. 4 shows a structure of an image forming apparatus according to a third embodiment of the present invention. In the third embodiment, each of the second to m-th (m being an integer larger than 2) tray units of the tray stack is provided with the skew correcting means or the register 10 and a controller 13 for switching operation mode of the register 10.

Figure 3:
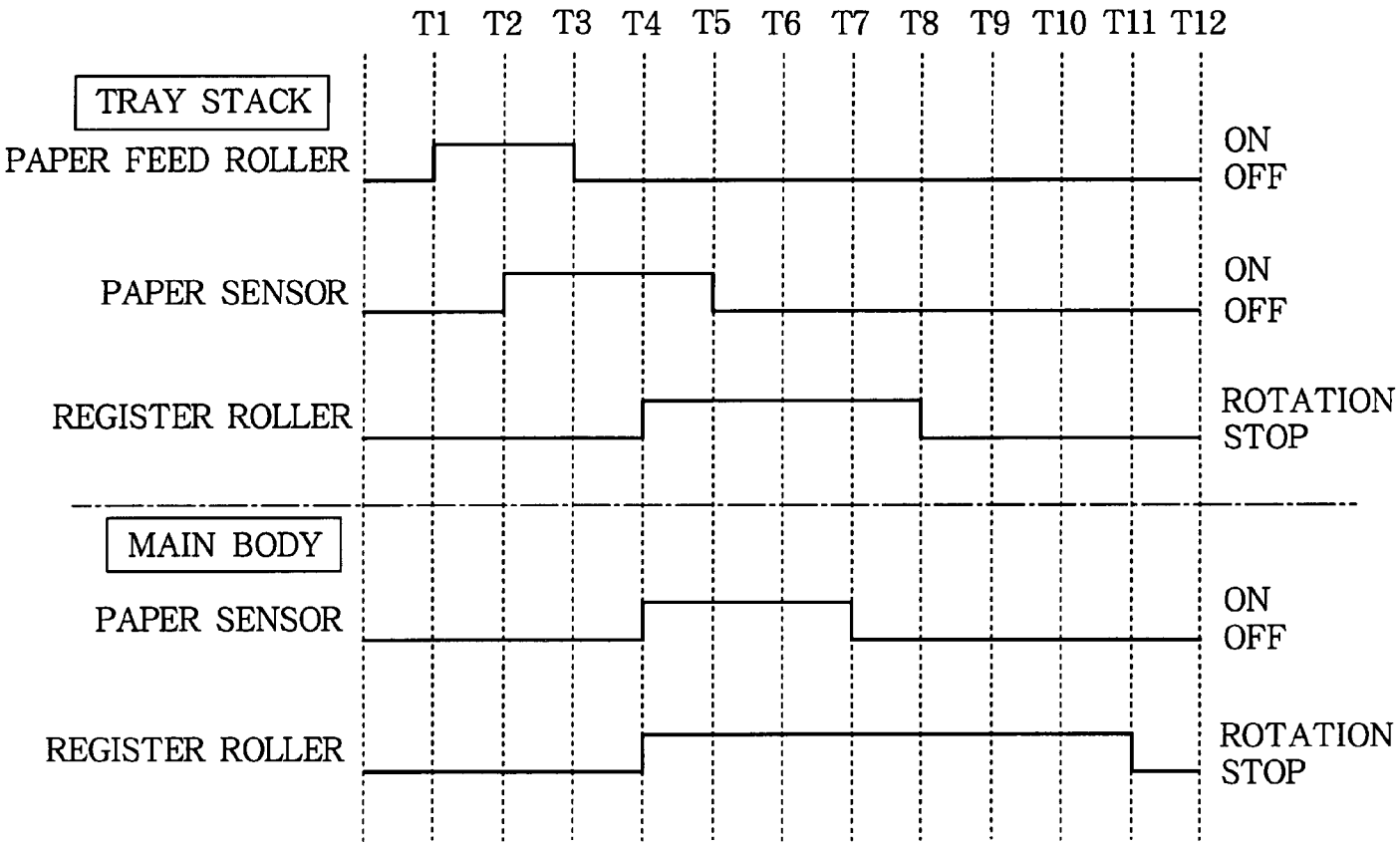
FIG. 3 is a time chart for explaining the operation of an image forming apparatus according to a second embodiment.

In FIG. 3, 1 denotes a main body of the image forming apparatus, 2 denotes a tray unit set in the main body and including a paper tray and a paper feed roller 3 for feeding sheets of paper by ones, 4 denotes a register constituted by two rollers, and 5 denotes a paper sensor. The pair of rollers constituting the register 4 is set to start to rotate after the paper supplied strikes on the register 4 and thereby the skew of the paper is corrected. The paper sensor 5 generates a signal used for timing the start of the rotation of the rollers of the register 4.

6 denotes an image forming unit constituted by an image drum on which an image is formed and a transference roller. 7 denotes a fixing unit constituted by a heater and a pressing roller for fixing the image formed by the image forming unit to the paper. 9 denotes a paper feed roller installed in each of the stacked tray units for feeding sheets of paper by ones. 10 denotes a register constituted by two rollers and installed in each of the stacked tray units. 11 denotes a paper sensor for detecting the front edge of the paper supplied (represented by the numeral 8 in FIG. 4). The pair of rollers constituting the register 10 is set to stat to rotate after the paper strikes thereon and the skew of the paper is therefore corrected. The paper sensor 11 generates a signal used for timing the start of the rotation of the rollers of the register 10.

12 denotes a motor for driving the paper feed roller 9 and the rollers constituting the register 10. 13 denotes the controller which switches operation mode of the register between operation mode 1 and operation mode 2 explained later. 14 denotes a control unit which controls the operation of the main body and sets operation mode of the controller 13 of each of the tray units to operation mode 1 or operation mode 2.

In the operation mode 1, the registering function of the register 10 is disabled, and the register 10 functions to only feed the paper. In the operation mode 2, the registering function of the register 10 is enabled, and the register 10 functions to correct the skew of the paper and then feed the paper. The controllers 13-2 to **13-*m*** are interconnected electrically by connectors.

Figure 5:
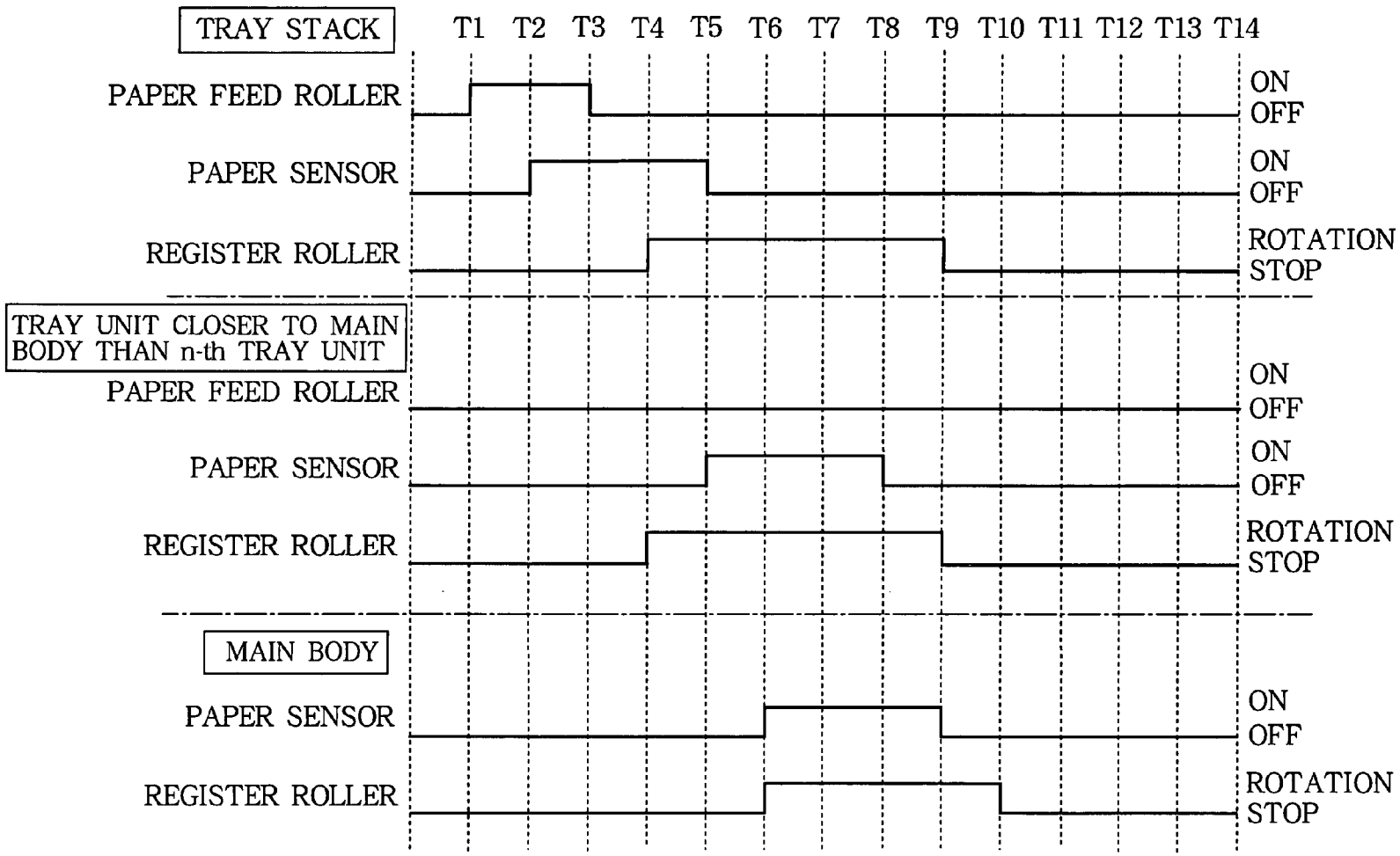
FIG. 5 is a time chart for explaining the operation of the image forming apparatus according to the third embodiment.

Next, the operation of the image forming apparatus having the structure described above will be explained with reference to a time chart shown in FIG. 5. The control unit 14 of the main body sends a second-operation-mode signal to the n-th (n being an integer larger than 2 and smaller than m) tray unit and sends a first-operation-mode signal to all of the tray units which are closer to the main body than the n-th tray unit (the tray units disposed above the n-th trays). The control unit 14 does not send any signal to the tray units which are farther from the main body than the n-th tray unit. Alternatively, the control unit 14 may send a signal to instruct the tray units which are farther from the main body than the n-th tray unit to be at a standstill.

When the second-operation-mode signal is received by the n-th tray unit, the paper feed roller **9-*n* of the n-th tray unit starts to rotate (T1), thereby paper is supplied from the paper tray of the n-th tray unit. When the paper reaches the register 10-*n*, the paper sensor 11-*n* is turned on (T2). The register 10-*n* remains at a standstill at this moment. The paper feed roller 9-*n* continues to rotate even after the paper sensor 11**-*n* is turned on for a predetermined time period in order to further feed the paper by a predetermined amount. In consequence, the paper is bent between the paper feed roller 9-*n* and the register 10-*n*. Then the paper feed roller 9-*n* is stopped in a state of the paper being bent (T3). The bend of the paper causes the front edge of the paper to strike on the rollers of the register 10-*n* throughout its length so that the skew of the paper is corrected.

After the skew is corrected, the pair of rollers constituting the register 10-*n* of the n-th tray unit is driven to rotate (T4). At this time, all of the registers of the tray units disposed above the n-th tray unit also operate (T4). However, although their pairs of rollers of these registers rotate, these registers do not execute the skew correction, since they have received the first-operation-mode signal. Thus, the paper supplied from the paper tray of the n-th tray unit enters the main body without undergoing the skew correction by the registers of the tray units disposed above the n-th tray unit since their registering functions have been disabled.

When the paper has reached the register 4 of the main body, the paper sensor 5 is turned on (T6). When the paper sensor 5 is turned on, the register 4 is driven to rotate (T6) to transport the paper to the image forming unit 6. When the paper passes through the paper sensor 5, and the paper sensor 5 is turned off (T9), the control unit 14 stops the registers of the tray units by sending a specific signal to the tray stack. The paper is transported to the image forming unit 6 and an image is formed on the paper there. After that, the paper is transported to the fixing unit 7 to fix the image, and then discharged.

Figure 6:
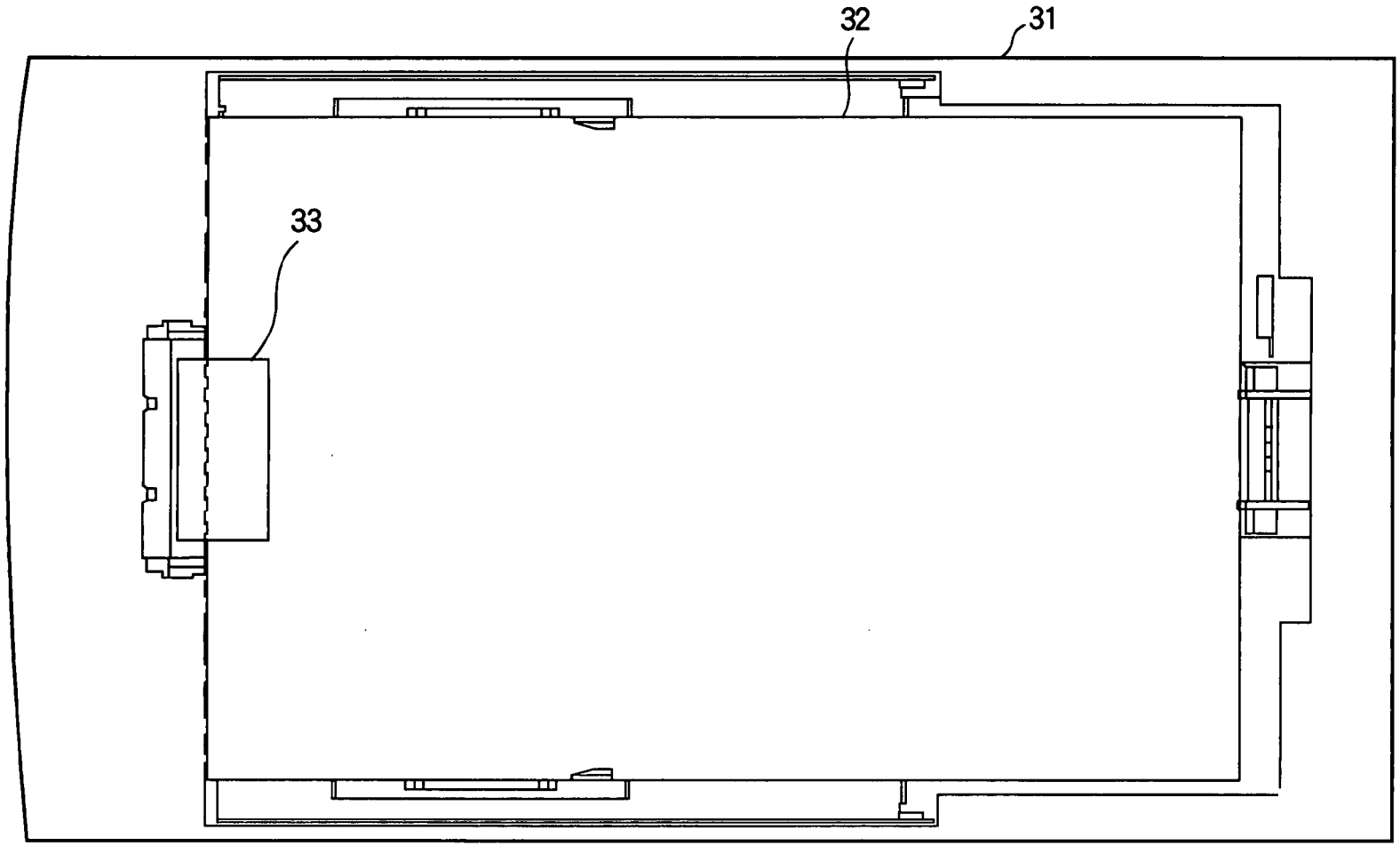
FIG. 6 is a top view of the tray unit.

FIG. 6 shows a top view of the tray unit. In FIG. 6, 31 denotes the tray unit, 32 denotes the paper, and 33 denotes the paper feed roller. As shown in FIG. 6, the paper feed roller 33 contacts only the center portion of the front edge of the paper. Accordingly the paper skews most commonly in being taken out of the paper tray by the paper feed roller 33. The skew of the paper occurred at the time of the paper being taken out of the paper tray may grow depending on manufacturing tolerance and installation tolerance of components constituting the paper passageway of the image forming apparatus. If the skew grows too much, it becomes difficult to correct. Accordingly it is desirable to execute the skew correction immediately after the paper has been taken out of the paper tray.

As explained above, according to the third embodiment of the invention in which the skew correction is executed immediately after the paper has been taken out of the paper tray, the skew of the paper can be removed efficiently and the printing speed reduction can be made small compared to conventional apparatuses in which the skew correction is executed at each of the tray units. When the tray units of the tray stack is small in number, the second embodiment which is simple in structure is advantageous, while when the tray units of the tray stack is large in number, the third embodiment in which the skew of the paper can be removed efficiently is advantageous.

Figure 7:
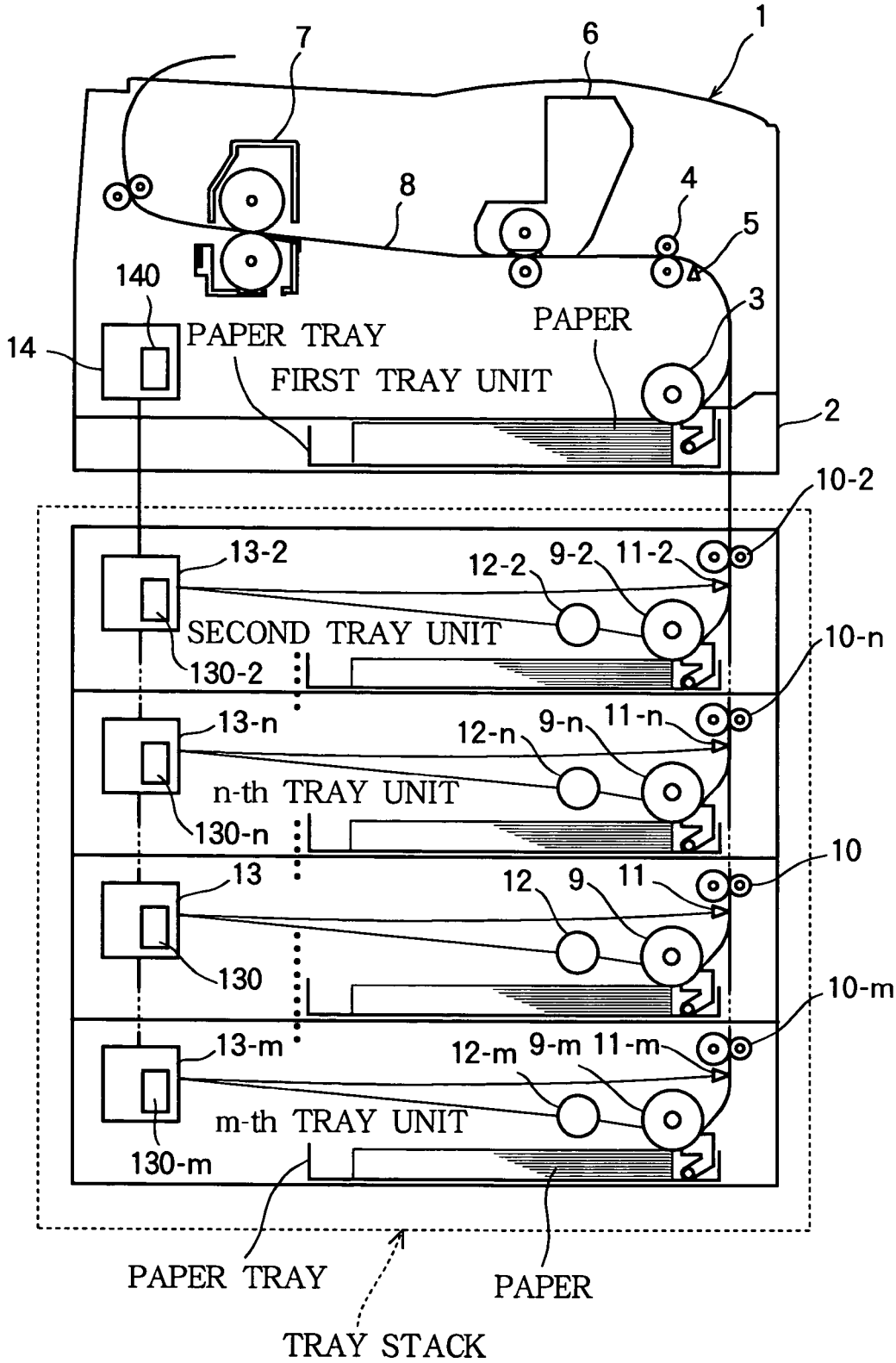
FIG. 7 shows a structure of an image forming apparatus according to a fourth embodiment of the present invention.

FIG. 7 shows a structure of an image forming apparatus according to a fourth embodiment of the present invention. The structure of the fourth embodiment differs from that of the third embodiment in that the control unit 14 includes a media type setting part 140, and the controllers 13-2 to 13-*m* of the tray units of the tray stack include registration-timing setting parts 130-2 to 130-*m* in the fourth embodiment.

The paper as printing media has thickness according to its type. The amount of bend of the paper appropriate to correct the skew of the paper which has reached the register varies according to the thickness of the paper. To be more precise, when the paper is thin, the amount of the bend should be large, while when the paper is thick, the amount of the bend should be small. The image forming apparatus according to the fourth embodiment is characterized in that the amount of the bend of the paper is automatically set to a value appropriate to the type of the paper that has been selected by the user, so that the skew correction is performed properly.

In the fourth embodiment, when the user selects the type of paper among menu items including "thick paper" and "thin paper", for example by use of an operation panel of the main body (not shown), the information about the type of paper selected is stored in the media type setting part 140. After that, as is the case with the third embodiment, the control unit 14 of the main body sends the second-operation-mode signal to the n-th tray unit and sends the first-operation-mode signal to all of the tray units which are closer to the main body than the n-th tray unit (the tray units disposed above the n-th trays). The control unit 14 does not send any signal to the tray units which are farther from the main body than the n-th tray unit. Alternatively, the control unit 14 may send a signal to instruct all of the tray units which are farther from the main body than the n-th tray unit to be at a standstill.

When the second-operation-mode signal is received by the n-th tray unit, the paper feed roller 9-*n* of the n-th tray unit starts to rotate (T1), thereby paper is supplied from the paper tray of the n-th tray unit. When the paper reaches the register 10-*n*, the paper sensor 11-*n* is turned on (T2). The register 10-*n* remains at a standstill at this moment. The paper feed roller 9-*n* continues to rotate even after the paper sensor 11-*n* is turned on for a predetermined time period in order to further feed the paper by a predetermined amount. In consequence, the paper is bent between the paper feed roller 9-*n* and the register 10-*n*. Then the paper feed roller 9-*n* is stopped in a state of the paper being bent (T3).

In the fourth embodiment, the timing of stopping the paper feed roller is adjusted so that the amount of bend of the paper varies in accordance with its type which the user has selected. To be more specific, the time length between T2 and T3 to be set in the registration-timing setting parts 130 within the controller 13 is adjusted in accordance with the information stored in the media type setting part 140. The adjusted amount of bend of the paper causes the front edge of the paper to strike on the rollers of the register throughout its length so that the skew of the paper is corrected.

After the skew is corrected, the pair of rollers constituting the register 10-*n* of the n-th tray unit is driven to rotate (T4). At this time, all of the registers of the tray units disposed above the n-th tray unit also operate (T4). However, although their pairs of rollers of these registers rotate, these registers do not execute the skew correction, since they have received the first-operation-mode signal. Thus, the paper supplied from the paper tray of the n-th tray unit enters the main body without undergoing the skew correction by the registers of the tray units disposed above the n-th tray unit since their registering functions are disabled.

When the paper has reached the register 4 of the main body, the paper sensor 5 is turned on (T6). When the paper sensor 5 is turned on, the register 4 is driven to rotate (T6) to transport the paper to the image forming unit 6. When the paper passes through the paper sensor 5, and the paper sensor 5 is turned off (T9), the control unit 14 stops the registers of the tray units by sending a specific signal to the tray stack. The paper is transported to the image forming unit 6 and an image is formed on the paper there. After that, the paper is transported to the fixing unit 7 to fix the image, and then discharged.

Since thin paper lacks body, if it is not fed by a large amount after it has reached the register, the skew thereof cannot be corrected satisfactorily. Accordingly, in this embodiment, the amount of feed of the paper that has reached the register is set to a larger value if it is thin, so that the skew correction can be performed satisfactorily. On the other hand, since thick paper is firm, if it is fed too much after it has reached the register, the front edge thereof goes thorough the register and therefore the skew thereof cannot be corrected at all. It is possible to prevent the front edge of the paper from going through the register by increasing the pinching force of the rollers of the register. However, other members may deform in this case. Accordingly, such a measure is hard to adopt. In this embodiment, as explained above, the amount of bend of the paper in the case of its being thick is set to a smaller value than in the case of its being thin, whereby it becomes possible to prevent the front edge of the paper from going through the register so that the skew correction is performed with reliability.

Figure 8:
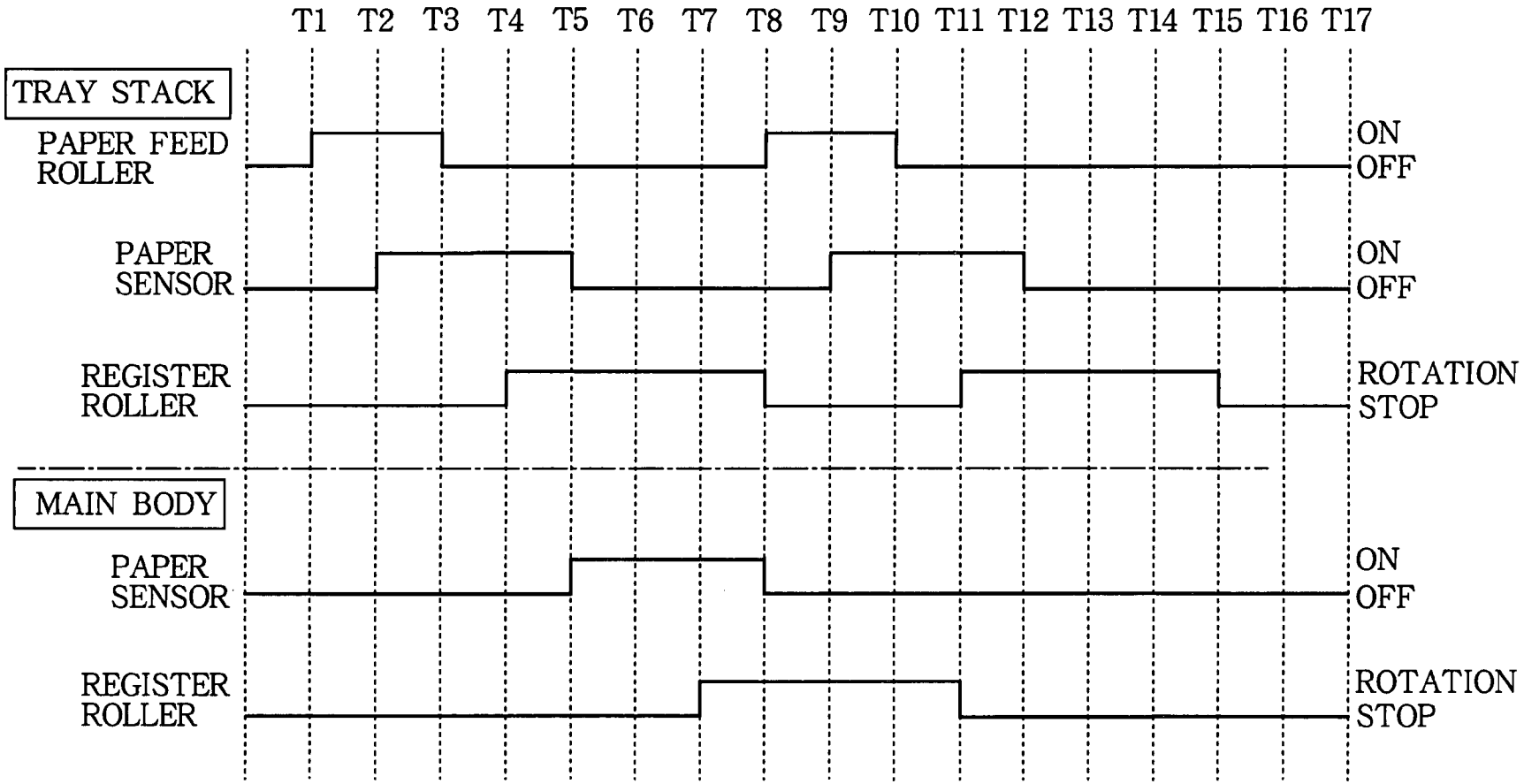
FIG. 8 is a time chart for explaining the operation of an image forming apparatus according to a fifth embodiment.
Figure 9:
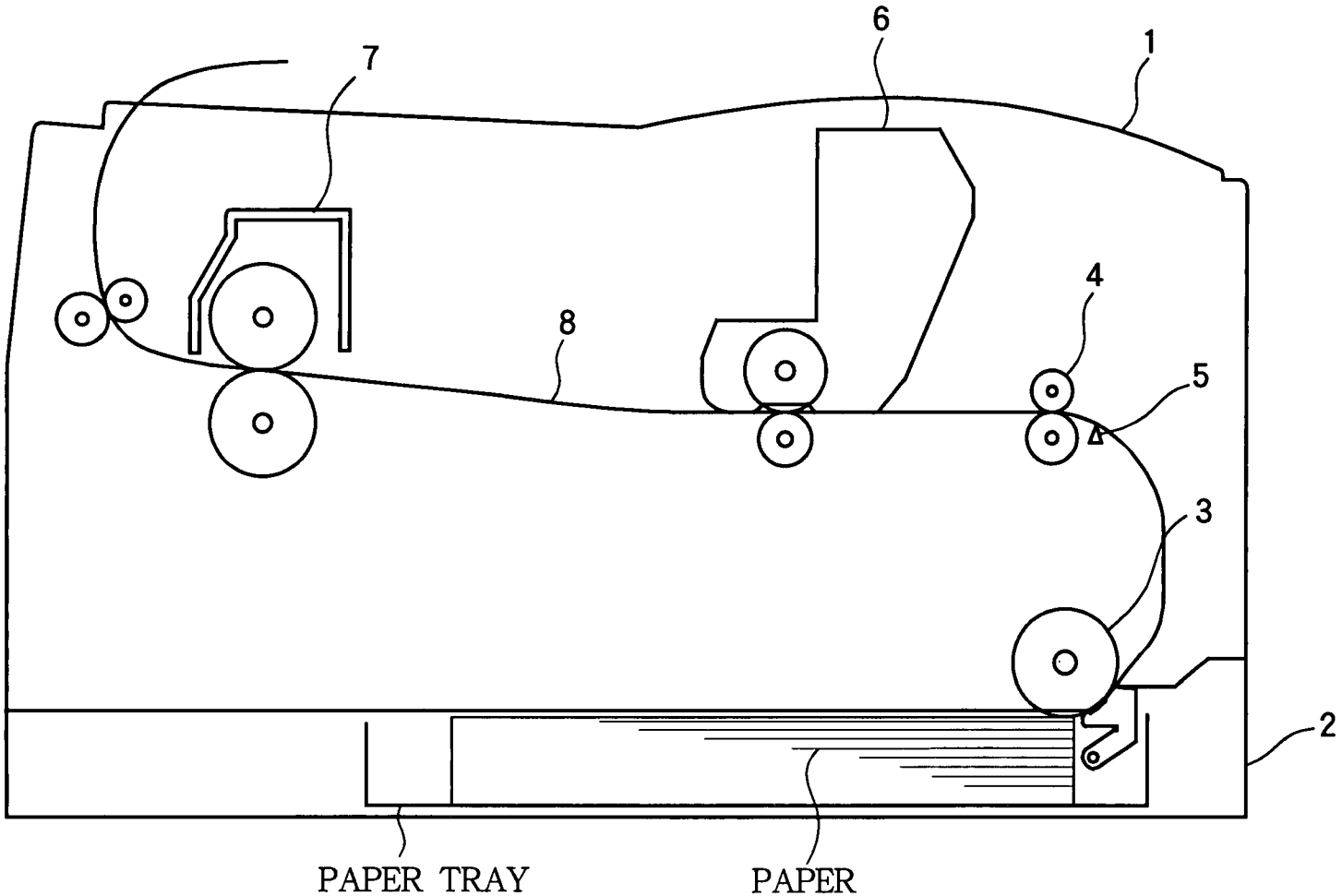
FIG. 9 shows a structure of a conventional image forming apparatus.

The image forming apparatus according to a fifth embodiment of the invention will be explained. The fifth embodiment has the same structure as the third embodiment. However, the paper feed timings in the fifth embodiment are different form those in the third embodiment. The fifth embodiment can perform continuous printing at a higher speed than the third embodiment. Accordingly, the explanation of the structure of the image forming apparatus according to the fifth embodiment will be omitted, and its operation will be explained below with reference to the time chart shown in FIG. 8.

The control unit 14 of the main body sends the second-operation-mode signal to the n-th tray unit and sends the first-operation-mode signal to all of the tray units which are closer to the main body than the n-th tray unit. The control unit 14 does not send any signal to the tray units which are farther from the main body than the n-th tray unit. Alternatively, the control unit 14 may send a signal to instruct all of the tray units which are farther from the main body than the n-th tray unit to be at a standstill.

When the second-operation-mode signal is received by the n-th tray unit, the paper feed roller 9-*n* of the n-th tray unit starts to rotate (T1), thereby paper is supplied from the paper tray of the n-th tray unit. When the paper reaches the register 10-*n*, the paper sensor 11-*n* is turned on (T2). The register 10-*n* remains at a standstill at this moment. The paper feed roller 9-*n* continues to rotate even after the paper sensor 11-*n* is turned on for a predetermined time period in order to further feed the paper by a predetermined amount. In consequence, the paper is bent between the paper feed roller 9-*n* and the register 10-*n*. Then the paper feed roller 9-*n* is stopped in a state of the paper being bent (T3). The bend of the paper causes the front edge of the paper to strike on the rollers of the register 10-*n* throughout its length so that the skew of the paper is corrected.

After the skew is corrected, the control unit 14 causes the controller 13-*n* to drive the rollers of the register 10-*n* of the n-th tray unit to rotate (T4). At this time, all of the registers of the tray units disposed above the n-th tray unit also operate (T4). However, although their pairs of rollers of these registers rotate, these registers do not execute the skew correction, since they have received the first-operation-mode signal. Thus, the paper supplied from the paper tray of the n-th tray unit enters the main body without undergoing the skew correction by the registers of the tray units disposed above the n-th tray unit since their registering functions have been disabled.

When the paper has reached the register 4 of the main body, the paper sensor 5 is turned on (T6). When the paper sensor 5 is turned on, the register 4 is driven to rotate (T6) to transport the paper to the image forming unit 6. In the fifth embodiment, the supply of the next paper starts when the first supplied paper has passed through the register of the tray stack (T8). The second paper undergoes the skew correction by the register 10-*n* as with the first paper, and is brought to a temporary stop at the register 10-*n*. Likewise, the third and further papers undergo the skew correction and are brought to a temporary stop at the register 10-*n* in succession.

In the fifth embodiment, as soon as the skew of the first paper is corrected, the second paper is supplied and brought to a temporary stop at the register. As a result, the printing speed of the image forming apparatus is improved.

In the third embodiment of the invention, although the skew correction is executed only within the tray stack and is not executed within the main body, the skew correction may be executed within the main body afresh after the skew correction is executed within the tray stack. In the fourth embodiment, although the amount of the bend of the paper at the register of the tray stack and at the register of the main body is adjusted depending on the thickness of the paper used, it may be adjusted depending on an output of a temperature sensor or a humidity sensor installed within the main body since the firmness of the paper is susceptible to its environment (temperature or humidity). In the fifth embodiment, the second and further papers are successively brought to a temporary stop in a state of their striking on the register after undergoing the skew correction, it is permissible to bring them to a temporary stop in a state of their front edges jutting from the register by a certain amount.

In each of the embodiments explained above, although the register is constituted by a pair of rollers, it is needless to say that the register may be constituted by any mechanism that can perform the skew correction.

The above explained preferred embodiments are exemplary of the invention of the present application which is described solely by the claims appended below. It should be understood that modifications of the preferred embodiments may be made as would occur to one of skill in the art.

What is claimed is:

1. An image forming apparatus comprising:

an image forming unit installed in a main body of the image forming apparatus for forming an image on a media piece;

a tray stack including at least an upper stacked media supplying unit and a lower stacked media supplying unit for supplying the media piece from a selected one of the stacked media supplying units to the image forming unit, the tray stack being detachable from and attachable to an underside of the main body;

wherein the tray stack includes:

a register installed in the upper stacked media supplying unit which functions to correct skew of the media piece supplied from the lower stacked media supplying unit with respect to a transport direction along which the media piece is transported and then feed the media piece to the image forming unit; and wherein the skew of the media piece supplied from the lower stacked media supplying unit is not corrected at the lower stacked media supplying unit.

2. An image forming apparatus according to claim 1, in which the register comprises a pair of rollers which are driven to rotate to feed the media piece, the pair of rollers being driven to rotate a predetermined time after the media piece being transported strikes thereon to correct the skew of the media piece.

3. An image forming apparatus according to claim 1, in which the register is installed in an uppermost one of the stacked media supplying units.

4. An image forming apparatus according to claim 1, wherein the main body includes another register that functions to feed the media piece to the image forming unit without correcting the skew of the media piece supplied from any of the stacked media supplying unit.

5. An image forming apparatus comprising:

an image forming unit installed in a main body of the image forming apparatus for forming an image on a media piece;

a tray stack including stacked media supplying units for supplying the media piece from a selected one of the stacked media supplying units to the image forming unit, the tray stack being detachable from and attachable to the main body;

wherein each of the stacked media supplying units includes:

a register which functions to feed the media piece to the image forming unit when the register is set in a first mode and functions to correct skew of the media piece with respect to a transport direction along which the media piece is transported and then feed the media piece to the image forming unit when the register is set in a second mode; and a controller for setting the register to one of the first mode and the second mode in accordance with an instruction received from outside;

wherein the main body includes another register that functions to feed the media piece to the image forming unit, wherein the another register has a function of correcting the skew of the media piece but does not correct the skew of the media piece supplied from any of the stacked media supplying units.

6. An image forming apparatus according to claim 5, in which the register installed in the media supplying unit comprises a pair of rollers which are driven to rotate to feed the media piece, the pair of rollers being driven to rotate a predetermined time after the media piece being transported strikes thereon to correct the skew of the media piece when the register is set in the second mode.

7. An image forming apparatus according to claim 5, in which a control unit is installed in the main body for supplying the instruction to each of the stacked media supply units.

8. An image forming apparatus according to claim 7, in which the control unit includes a media type setting part in which a media type designated by a user of the image forming apparatus is set, and the controller of each of the stacked media supplying units determines an amount of skew correction to be executed by the corresponding register depending on the media type set in the media type setting part.

9. An image forming apparatus according to claim 7, in which, when a first media piece is supplied from the selected one of the stacked media supplying units to the image forming unit, the control unit causes the controller of the selected one of the media supplying units to drive the corresponding register such that a second media piece is fed from the selected one of the media supplying units after the first media piece passes through the register of the selected one of the stacked media supplying units, undergoes skew correction by the register of the selected one of the stacked media supplying units, and is brought into a temporary stop at the register of the selected one of the stacked media supplying units.

10. A media supplying unit for supplying a media piece to an image forming apparatus that includes an image forming unit for forming an image on the media piece, the media supplying unit comprising:

a register which functions to feed the media piece to the image forming unit and does not correct skew when the register is set in a first mode and functions to correct skew of the media piece with respect to a transport direction along which the media piece is transported and then feed the media piece to the image forming unit when the register is set in a second mode; and a controller for setting the register to one of the first mode and the second mode in accordance with an instruction received from outside;

wherein the register corrects the skew of the media piece when the media piece is supplied from a lower media supplying unit.

11. An image forming apparatus comprising:

an image forming unit installed in a main body of the image forming apparatus for forming an image on a media piece;

a tray stack including stacked media supplying units for supplying the media piece from a selected one of the stacked media supplying units to the image forming unit, the tray stack being detachable from and attachable to the main body;

wherein the tray stack includes:

a register installed in at least one of the stacked media supplying units which functions to correct skew of the media piece with respect to a transport direction along which the media piece is transported and then feed the media piece to the image forming unit, and wherein the main body includes another register that functions to feed the media piece to the image forming unit, wherein the another register has a function of correcting the skew of the media piece but does not correct the skew of the media piece supplied from any of the stacked media supplying units.

12. An image forming apparatus according to claim 11, in which the register comprises a pair of rollers which are driven to rotate to feed the media piece, the pair of rollers being driven to rotate a predetermined time after the media piece being transported strikes thereon to correct the skew of the media piece.

13. An image forming apparatus according to claim 11, in which the skew of the media piece fed from any one of the stacked media supplying units which are disposed below the media supplying unit having the register is corrected by the register.

14. An image forming apparatus according to claim 11, in which the register is installed in uppermost one of the stacked media supplying units.

15. An image forming apparatus comprising:

an image forming unit installed in a main body of the image forming apparatus for forming an image on a media piece;

a tray stack including stacked media supplying units for supplying the media piece from a selected one of the stacked media supplying units to the image forming unit, the tray stack being detachable from and attachable to the main body;

wherein the tray stack includes:

a register installed in the stacked media supplying unit closest to the main body which functions to correct skew of the media piece with respect to a transport direction along which the media piece is transported and then feed the media piece to the image forming unit, wherein the correction of the skew of the media piece is executed only by the register of the stacked media supplying unit closest to the main body.

16. An image forming apparatus according to claim 15, in which the register comprises a pair of rollers which are driven to rotate to feed the media piece, the pair of rollers being driven to rotate a predetermined time after the media piece being transported strikes thereon to correct the skew of the media piece.

* * * * *